United States Patent [19]

Barcelow et al.

[11] Patent Number: 4,480,833

[45] Date of Patent: Nov. 6, 1984

[54] AMUSEMENT GAME

[75] Inventors: David M. Barcelow, Kenmore; John R. Callahan, Buffalo; Michael T. Johnson, Kenmore, all of N.Y.

[73] Assignee: Innovative Concepts in Entertainment, Inc., New York, N.Y.

[21] Appl. No.: 366,342

[22] Filed: Apr. 7, 1982

[51] Int. Cl.[3] ..... A63F 7/06; A63F 7/30

[52] U.S. Cl. ..... 273/85 B; 273/126 A; 335/205

[58] Field of Search ..... 273/85 B, 85 A, 85 C, 273/85 D, 85 R, 85 F, 121 A, 119 A, 127 C, 371, 375, 126 A; 335/205

[56] References Cited

U.S. PATENT DOCUMENTS

| | | | |
|---|---|---|---|
| 2,114,138 | 4/1938 | Corsello | 273/119 A UX |
| 2,507,258 | 5/1950 | Kohler | 273/85 B |
| 2,582,290 | 1/1952 | Smith | 273/127 C X |
| 2,585,153 | 2/1952 | Metz | 273/126 A |
| 2,709,594 | 5/1955 | Brandell | 273/127 C X |
| 2,966,561 | 12/1960 | Durant | 273/126 A X |
| 3,104,289 | 9/1963 | Segel | 335/205 X |
| 3,428,316 | 2/1969 | Cane | 273/85 B |
| 3,554,547 | 1/1971 | Vedeen et al. | 273/85 B |
| 3,575,559 | 4/1971 | Tierney | 273/375 X |
| 4,145,224 | 3/1979 | Deutsch | 273/85 B X |
| 4,210,888 | 7/1980 | Holce | 335/205 X |
| 4,272,649 | 6/1981 | Pfeiffer | 273/121 A X |
| 4,340,370 | 7/1982 | Marshall | 273/371 X |

FOREIGN PATENT DOCUMENTS

| | | | |
|---|---|---|---|
| 632798 | 12/1961 | Canada | 273/85 B |
| 493447 | 3/1930 | Fed. Rep. of Germany | 273/85 F |
| 2836657 | 3/1979 | Fed. Rep. of Germany | 273/85 B |
| 1081695 | 6/1954 | France | 273/85 F |
| 1355361 | 2/1964 | France | 273/85 E |
| 1380734 | 8/1964 | France | 273/85 A |
| 431593 | 3/1948 | Italy | 273/85 F |
| 557352 | 2/1957 | Italy | 273/85 F |
| 90399 | 9/1937 | Sweden | 273/85 F |
| 789869 | 1/1958 | United Kingdom | 273/85 F |
| 823331 | 11/1959 | United Kingdom | 273/85 F |
| 1394464 | 5/1975 | United Kingdom | 273/85 D |

OTHER PUBLICATIONS

Coleco World of Sports catalog 3-1970, p. 4, NHL Official #5341 & 5342.

*Primary Examiner*—Paul E. Shapiro
*Attorney, Agent, or Firm*—Cullen, Sloman, Cantor, Grauer, Scott & Rutherford

[57] ABSTRACT

An electromechanical amusement game apparatus including a frame, a playing surface supported by the frame, at least one player element movable by a manually operated mechanism along an elongated track in the playing surface, and a player piece movable along and over the playing surface in response to being engaged and propelled by the player element. A pair of the player elements are in opposed relation in a single track for movement therealong toward, in contact with, and away from each other in response to manipulation of the manually operated mechanism. As a result, a person playing the game can manually force his player element into contact with the player element of another person playing the game in a manner physically interfering with each other similar to checking in hockey and contact in other sports. The game playing surface is enclosed in a transparent hollow cover which supports a scoreboard and clock simulating structure in suspended relation over the playing surface. The game includes timing and scorekeeping functions similar to those of an actual game being simulated. There are two scoring areas at opposite ends of the playing surface for receiving the player piece in a manner causing a score, score sensors in the areas for signalling a score and additional sensors adjacent each area for signalling a near miss. A sound generator carried by the frame and operatively connected to all of the sensors provides sound of a first type in response to a score and sound of a second type in response to a near miss.

11 Claims, 18 Drawing Figures

14
36
22
56g
150
52g
150
144g
146
146
24

188e
52e
186e
180e
184e
6
6
182e 184e
52e
182e
180e 140
22
52g
4
4
56g
56d
52d
56i
52i
328
90
390
52b
56b
52e
56e
268
142
18
160f
162f
144g
144d
144i
308
336
314
144b
144c
162d
180g
162b
310
316
320
322
392
180b
194b
160d
264
196h
362
370
356
396
394
196b
196f
180e
194h
160b
196j
334
196a
194f
24
190i
194j
194a
16
180j
180a
162g
160g
162h
160h
160a
180d
180i
194d
194i
194g
190j
162a
9
10
10
196d
196i
194e
196c
384
386
302
354
364
360
260
180h
196g
194c
180f
9
180c
290
382
276
282
284
162c
130
288
274
160c
140
144h
160e
162e
144c
382
380
304
144j
144a
144f
142
56h
52h
20
56c
52c
76
280
296
52j
56j
52a
56a
52f
56f
136
132

AMUSEMENT GAME

BACKGROUND OF THE INVENTION

This invention relates to the art of amusement games, and more particularly to a new and improved coin-operated, electromechanical amusement game to be played by at least two persons.

One area of use of the present invention is in a game resembling hockey or similar contact sports, although the principles of the present invention can be variously applied. It would be highly desirable to provide a game wherein player members operated by persons playing the game can physically interfere with each other in a manner similar to checking in hockey and contact in other sports. The realism provided by the foregoing could be enhanced by providing timing and score keeping functions, by generation of sounds simulating crowd noise at an actual spectator sport and by providing game structure simulating the actual facility where a real game is played. It also would be highly desirable to provide such a game which is truly a game of skill and co-ordination on the part of persons playing the game, rather than being merely a game of chance.

SUMMARY OF THE INVENTION

It is, therefore, a primary object of this invention to provide a new and improved amusement game of the electromechanical type.

It is a further object of this invention to provide such a game wherein player members in the game can physically interfere with each other in a manner similar to checking in hockey and contact in other sports.

It is a further object of this invention to provide such a game which is truly a game of skill and co-ordination on the part of persons playing the game rather than merely a game of chance.

It is a further object of this invention to provide such a game wherein the pace of the game is determined by the skill level of the persons playing the game.

It is a further object of this invention to provide such a game including timing and score keeping functions found in an actual game of the type being simulated.

It is a further object of this invention to provide such a game including generation of sounds during play of the game similar to those occurring during an actual game of the type being simulated.

It is a further object of this invention to provide such a game having structure closely resembling a facility for play of an actual game of the type being simulated.

The present invention provides electromechanical amusement game apparatus including a frame, a playing surface supported by the frame, at least one player element movable by manually operated means along an elongated track in the playing surface, and a player piece movable along and over the playing surface in response to being engaged and propelled by the player element. A pair of the player elements are in opposed relation in a single track for movement therealong toward, in contact with, and away from each other in response to manipulation of the manually operated means. As a result, a person playing the game can manually force his player element into contact with the player element of another person playing the game in a manner physically interfering with each other similar to checking in hockey and contact in other sports. The game playing surface is enclosed in a transparent hollow cover which supports a score board and clock simulating structure in suspended relation over the playing surface. The game includes timing and score keeping functions similar to those of an actual game being simulated. There are two scoring areas at opposite ends of the playing surface for receiving the player piece in a manner causing a score, score sensing means in each area for signalling a score and additional sensing means adjacent each area for signalling a near miss. Sound generating means carried by the frame and operatively connected to all of the sensing means provides sound of a first type in response to a score and sound of a second type in response to a near miss.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

Figure 1:
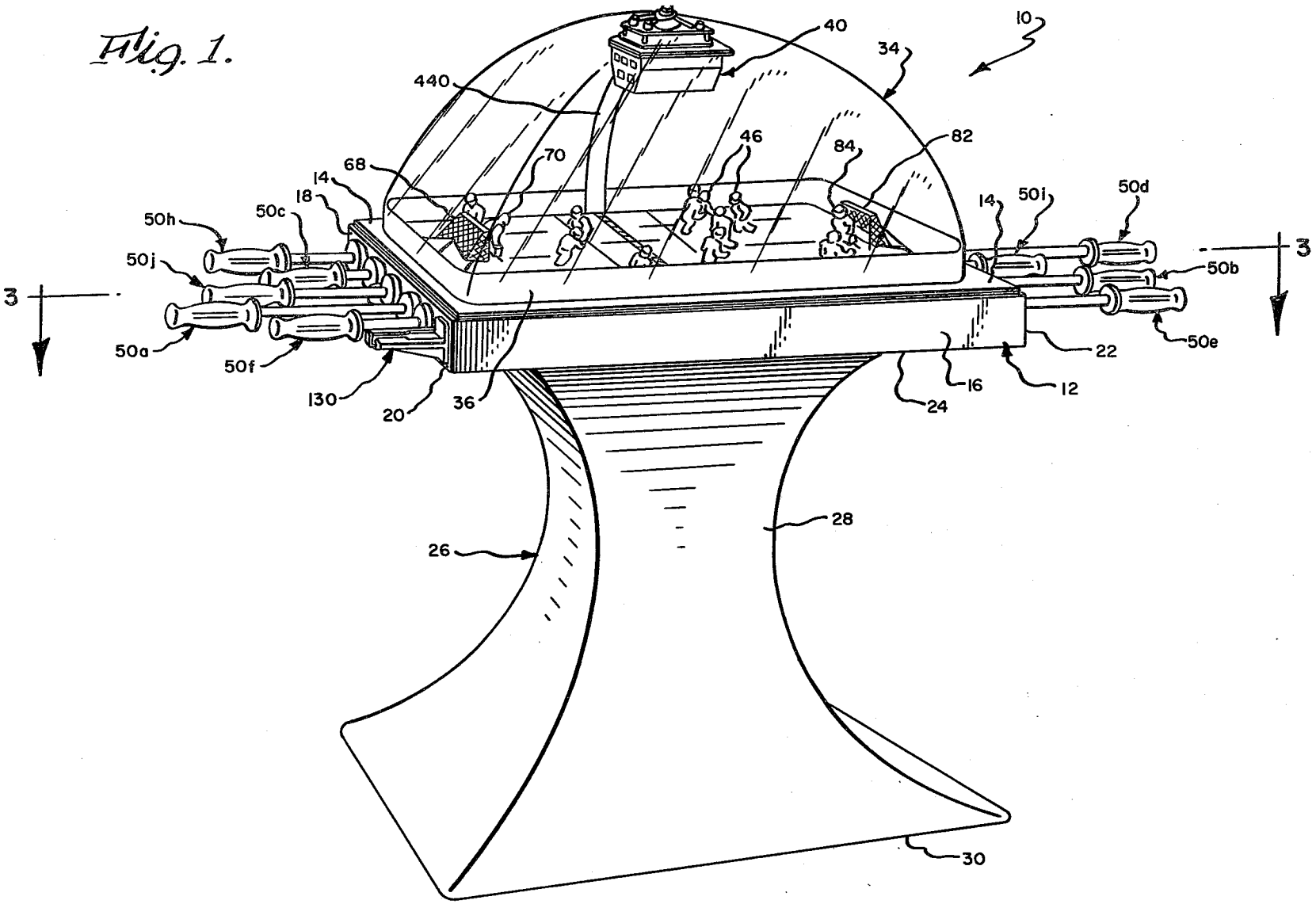
FIG. 1 is a perspective view of the amusement game apparatus according to the present invention.

Referring now to FIG. 1, the game apparatus 10 according to the present invention includes a generally hollow rectangular frame 12 having an upper surface 14 which also defines the game playing surface in a manner which will be described and is completed by a pair of side walls 16,18, end walls 20,22 and a bottom wall 24.

In the game shown the frame 12 is supported above a floor or similar surface by a base generally designated 26 having a body portion 28, a flat bottom surface 30 and a top surface upon which the bottom surface 24 of frame 12 is fixed. Base 26 preferably is of a height such that persons playing the game can stand therearound and the frame 12 is at an elevation from the floor providing an effective and comfortable mode of manual operation of elements associated with the game in a manner which will be described in detail presently. The game playing surface is enclosed within a hollow, substantially transparent cover generally designated 34. Cover 34 serves the dual purposes of preventing dust or other debris from contaminating the playing surface and movable elements of the game and preventing removal of player elements or pieces from the game apparatus. Cover 34 preferably is of suitable plastic material having sufficient strength and optical transparency, and one material found to perform satisfactorily is available commercially from the General Electric Company under the trademark Lexan. Other materials can of course be employed. Cover 34 is substantially semi-spherical in shape in the upper region therof as viewed in FIG. 1, and it terminates in a substantially rectangular rim or border region designated 36 which outlines the playing surface of the game. The rim 36 in the game shown is made non-transparent, such as by coating with paint or like material. The game shown simulates a spectator sport such as hockey, in a manner which will be described in further detail presently, and the cover 34 serves the additional purpose of supporting a scoreboard and time indicator or clock assembly generally designated 40 which is attached at the upper region of cover 34. Thus, cover 34 and assembly 40 simulate the location of the scoreboard and clock in many actual ice hockey rinks. The rim 36 simulates the boarding area surrounding the ice surface in an actual rink.

Figure 2:
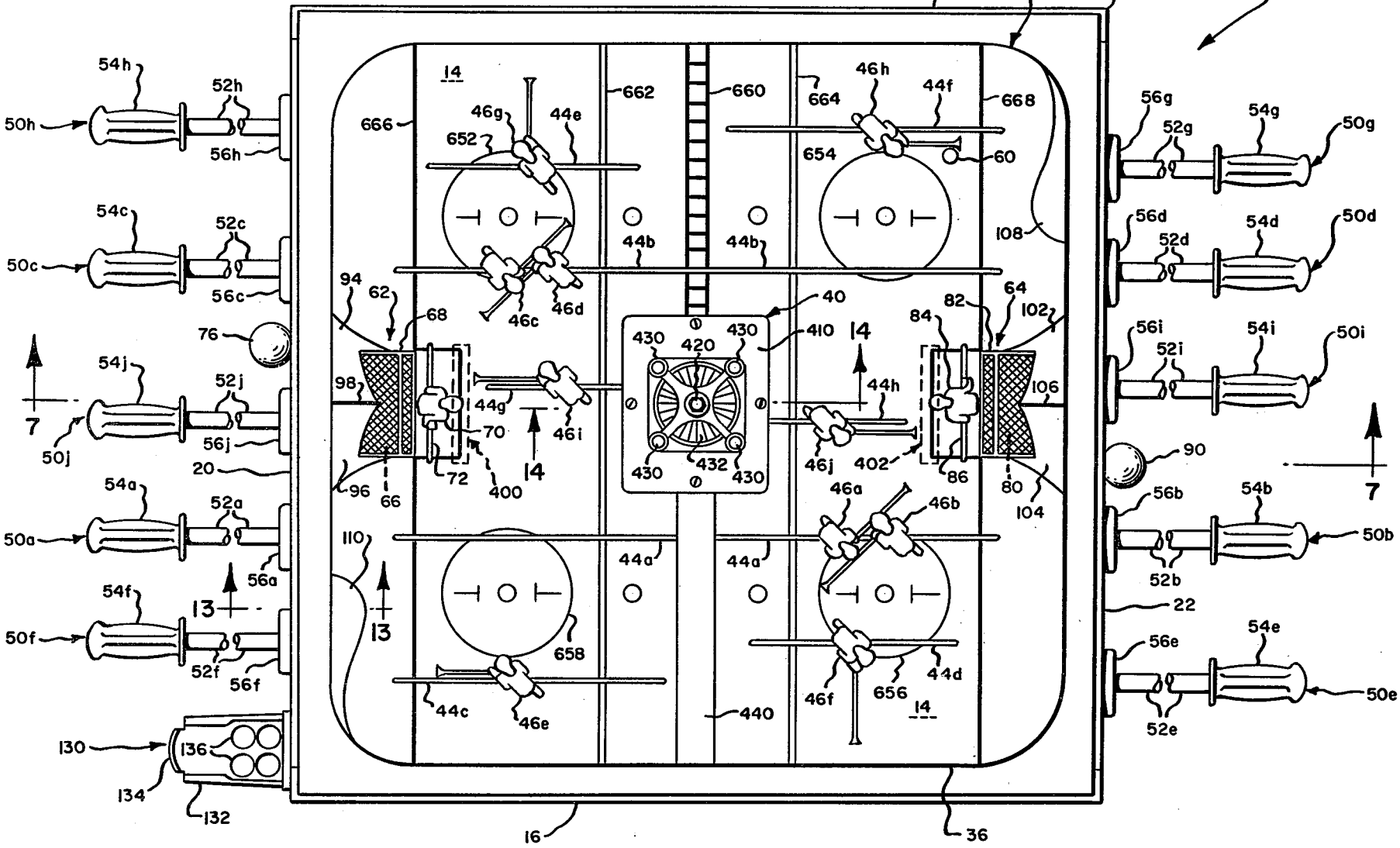
FIG. 2 is a top plan view thereof.

As shown in more detail in FIG. 2, the game apparatus 10 according to the present invention further comprises at least one elongated track in playing surface 14 and at least one player element supported in the track for movement therealong. In particular, a first track includes an elongated slot 44*a* which extends along a major portion of the length of playing surface 14 between frame end walls 20 and 22. Slot 44*a* is disposed substantially parallel to the side walls 16,18 and is located between the center of playing surface 14 and the one side wall 16. A pair of player elements 46*a*,46*b* are supported in the slot 44*a* of the track for movement along the track toward, in contact with, and away from each other in a manner which will be described. In the game shown which simulates hockey, the player elements 46*a*,46*b* simulate hockey players and have elements simulating hockey sticks as a part thereof.

A typical game includes a plurality of additional tracks and player elements, and in the game shown there is another slot 44*b* of a similar elongated track extending along a major portion of the length of playing surface 14 between the ends 20,22 and located between the center of the playing surface 14 and the other side wall 18. Slot 46*b* is disposed parallel to slot 44*a*. A pair of player elements 46*c* and 46*d* *are supported in slot 44b* of the track for movement along the track toward, in contact with, and away from each other in a manner identical to that of the player elements 46*a* and 46*b*. In the game shown there are a plurality of additional tracks having slots of a length significantly shorter than the slots 44*a*, 44*b* and including only a single player element. In particular, there is a track having a slot 44*c* located near the corner of playing surface 14 defined by the junction of end wall 20 and side wall 16 at the lower left hand portion of FIG. 2. Slot 44*c* is disposed parallel to slot 44*a* and extends for a distance less than about half the length of slot 44*a* between end wall 22 and the midpoint of the length of surface 14. A player element 46*e* is supported in the track of slot 44*c* for movement therealong. Similarly, another track having a slot 44*d* is located near the lower right hand corner of the playing surface 14 as viewed in FIG. 2 near the junction of sidewall 16 and end wall 22. Slot 44*d* has a length less than half the length of slot 44*a* , is disposed parallel to slot 44*a* and extends between end wall 22 and the midpoint of the length of surface 14. The length of slot 44*d* is less than that of slot 44*c*, and the slots 44*c*,44*e* are laterally offset. A player element 46*f* is supported for movement along slot 44*d*.

In a similar manner corresponding tracks and player elements are included in the upper left hand and right hand portions of the playing surface 14 as viewed in FIG. 2. In particular, there is a track including slot 44*e* having a player element 46*g* supported for movement therealong located near the left-hand corner, and a track including slot 44*f* having player element 46*h* movable along near the right-hand corner. Slots 44*e*,44*f* are laterally offset and slot 44*f* is slightly longer. In the game shown there are two additional tracks and corresponding player elements located between the slots 44*a* and 44*b* and associated with opposite ends of the playing surface 14. There is an elongated track having a slot 44*g* disposed parallel to slots 44*a*,44*b* and extending along a portion of playing surface 14 between end wall 20 and the midpoint of the length of the playing surface. Slot 44*g* is slightly laterally offset from the center line or longitudinal axis of surface 14, being located slightly closer to slot 44*b*. A player element 46*i* is supported in slot 44*g* for movement therealong. Another elongated track having a slot 44*h* is located between the center of playing surface 14 and end wall 22, being in laterally offset relation to the longitudinal axis of the playing surface and slightly closer to slot 44*a*. A player element 46*j* is mounted for movement along the track. Slots 44*g* and 44*h* are in laterally offset, parallel relation.

The game of the present invention further comprises manually operated means operatively connected to each of the player elements 46 for moving the corresponding player element in opposite directions along the corresponding track. Each track in addition to the slot in the playing surface 14 as shown in FIG. 2 also comprisea an elongated supporting means fixed to the frame below surface 14 and extending along the slot in manner which will be described. Each of the manually operated means comprises a coupling element which will be described in detail presently and which is in slidable engagement with the corresponding elongated supporting means and located below the playing surface. Each player element 46 has a portion located above the playing surface 14 as shown in FIGS. 1 and 2 and a portion extending to the corresponding slot in the playing surface and operatively connected to the corresponding coupling element. Each manually operated means further comprises a rod element mounted in frame 12 for reciprocal movement, the rod being connected at one end to the corresponding coupling element and extending at the opposite end outwardly from the frame and terminating in a hand grip element. Thus, as shown in FIG. 2, each of the manually operated means includes a rod 52 having a hand grip 54 at the outer end thereof and extending into the frame, in particular through openings the end walls 20,22 received in bumpers 56 and extending beneath the playing surface for connection to the coupling elements in a manner which will be described. A plurality of disc-shaped bumper elements 56, one for each rod, are fixed to end walls 20,22 and have a central openings through which the rods 52 extend, the bumpers 56 being of plastic or like material serving to cushion impact with the corresponding hand grip elements 54 when the rods are pushed the full extend into the frame. For convenience in illustration, the manually operated means are designated by numbers and by lower case letters corresponding to the associated player elements. Thus, rod **52*a* is coupled to player element 46*a*. Thus, when a person playing the game pushes and pulls a selected manually operated means 50**, the corresponding player element is reciprocated along the slot in the playing surface in a manner which will be described in further detial presently.

The game of the present invention further includes a player piece generally designated 60 freely movable over and along the playing surface. In the game shown simulating the playing of hockey, the player piece 60 resembles a hockey puck. Thus, there is one player piece, and it is shown for example adjacent the stick portion of player element **46*h* in the upper right-hand corner of FIG. 2. In addition, there is provided means operatively associated with each of the manually operated means 50 for moving the corresponding player elements in another direction in addition to along the track in response to manipualtion of the manually operated means 50 for contacting and moving the player piece 60 along the playing surface. In the game of the present illustration, the player elements 46 are rotatable about an axis substantially perpendicular to the plane of playing surface 14 in response to manual rotation of the rods 52** in a manner which will be described.

The game of the present invention further comprises at least one scoring area for receiving the player piece 60. In the game shown there is a pair of scoring areas each generally designated 62 and 64 at opposite ends of the playing surface 14 spaced inwardly of the end walls 20 and 22. Each scoring area includes an opening in the playing surface 14 through which the player piece 60 can travel, and in the game shown simulating hockey each scoring area also includes structure simulating a hockey net together with a manually operated movable player element simulating a goalie. Turning first to the scoring area designated 62, there is an opening 66 in playing surface 14 and a structure 68 simulating a goal net fixed to surface 14 over the opening and which will be described in further detail presently. A player element 70 simulating a goalie is movable in opposite directions along a track including slot 72 in playing surface 14 extending substantially parallel to the plane of wall 20 and across the entire length of the open front portion of net 68. The player element 70 is moved in response to manual rotation of a knob 76 extending out from end wall 20 in a manner which will be described. Similarly, at the opposite end of the playing surface 14 there is an opening 80 in playing surface 14 for receiving piece 60, a net structure 82 fixed to surface 14 and located over opening 80, a player element 84 simulating a goalie which is movable back and forth along a track including slot 86 extending across the entire front opening of the net structure 82, and the player element 84 is moved in response to a knob 90 in a manner which will be described.

Figure 13:
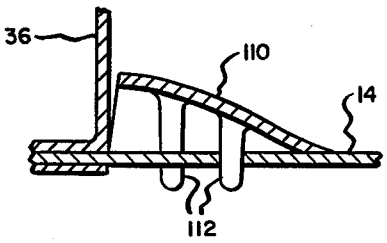
FIG. 13 is a sectional view taken about on line 13—13 in FIG. 2.

The playing surface 14 as shown in FIG. 2 is provided with various formation structures to prevent the small player piece 60 from becoming inaccessible to the player elements 46. These formations, briefly, are located behind the goal net structures 68 and 82 at the opposite ends of the playing surface 14 and at two of the diagonally opposite corner regions. In particular, behind the goal net structure 62, i.e. between the net structure and the rim portion 36 of the cover 34, where is provided a ramp-like formation including first and second upwardly inclined surface portions 94 and 96, respectively, which meet at an edge 98 defining a peak. The surface portions 94 and 96 extend upwardly toward edge 98 which is located at a height about $\frac{1}{3}$ the height of the net structure 68. Similarly, at the opposite end of the playing surface 14, behind the net structure 82 there is provided a ramp-like formation including a pair of upwardly extending inclined surfaces 102,104 which meet at an edge 106 defining a peak in a manner identical to that of the surfaces 94 and 96. The surface portions 94,96, 102 and 104 can be provided by suitably shaped and formed inserts of plastic material or the like attached to surface 14. At two opposite corners of playing surface 14 there is provided a pair of inserts 108 and 110 having a curved outer surface as shown in more detail in FIG. 13. The inserts 108,110 are held in place by integrally formed rod-like elements 112 which are received in openings in playing surface 14.

Figure 15:
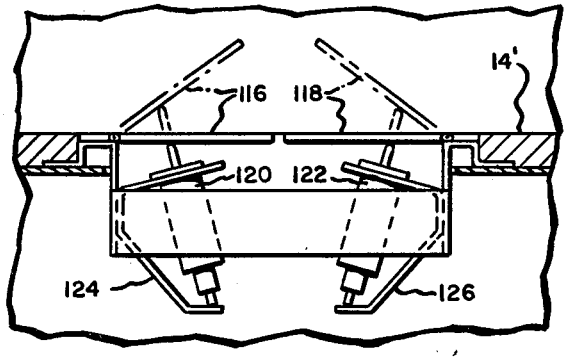
FIG. 15 is a fragmentary sectional view illustrating a flipper mechanism for moving the player piece from an inaccessible area on the playing surface.

As an alternative to the formations behind the net structures and/or the corner formations, there can be provided movable floor sections operated by suitable motive means under the control of the game players for propelling the player piece 60 from the area of the movable sections. As shown in FIG. 15, for example, a pair of movable floor sections of flipper elements 116,118 can be located behind the goal net structure and suitable hingedly connected along the edge of an opening provided in the playing surface 14. The normal position of the sections 116,118 is horizontal, i.e. coplanar with the surface 14', and when the player piece 60 lands on either or both they may be moved abruptly to an inclined position as shown in broken lines in FIG. 15 to propel the player piece 60 from that area to another area of playing surface 14 where it is accessible by the player elements. The foregoing can be accomplished by a pair of solenoids 120,122 held in suitable bracket structres 124,126 beneath the playing surface 14' with the solenoid plungers engaging corresponding ones of the flipper elements 116,118.

The game of the present invention typically is coin-operated and for this purpose includes a conventional coin-inserting and storing mechanism generally designated 130, and in the game shown mechanism 130 is located in the region of the lower left hand corner of the playing surface 14 as viewed in FIG. 2 and extends outwardly from the end wall 20. The mechanism 130 includes, briefly, a stationary frame 132 and a movable manually operated coin inserting component 134 having a plurality of coin receiving recess designated 136. Other means for inserting money to the game can of course be employed.

Figure 4:
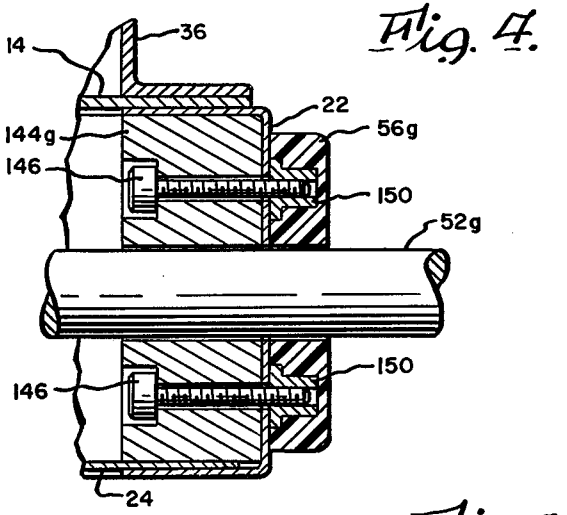
FIG. 4 is a sectional view taken about on line 4—4 in FIG. 3.
Figure 3:
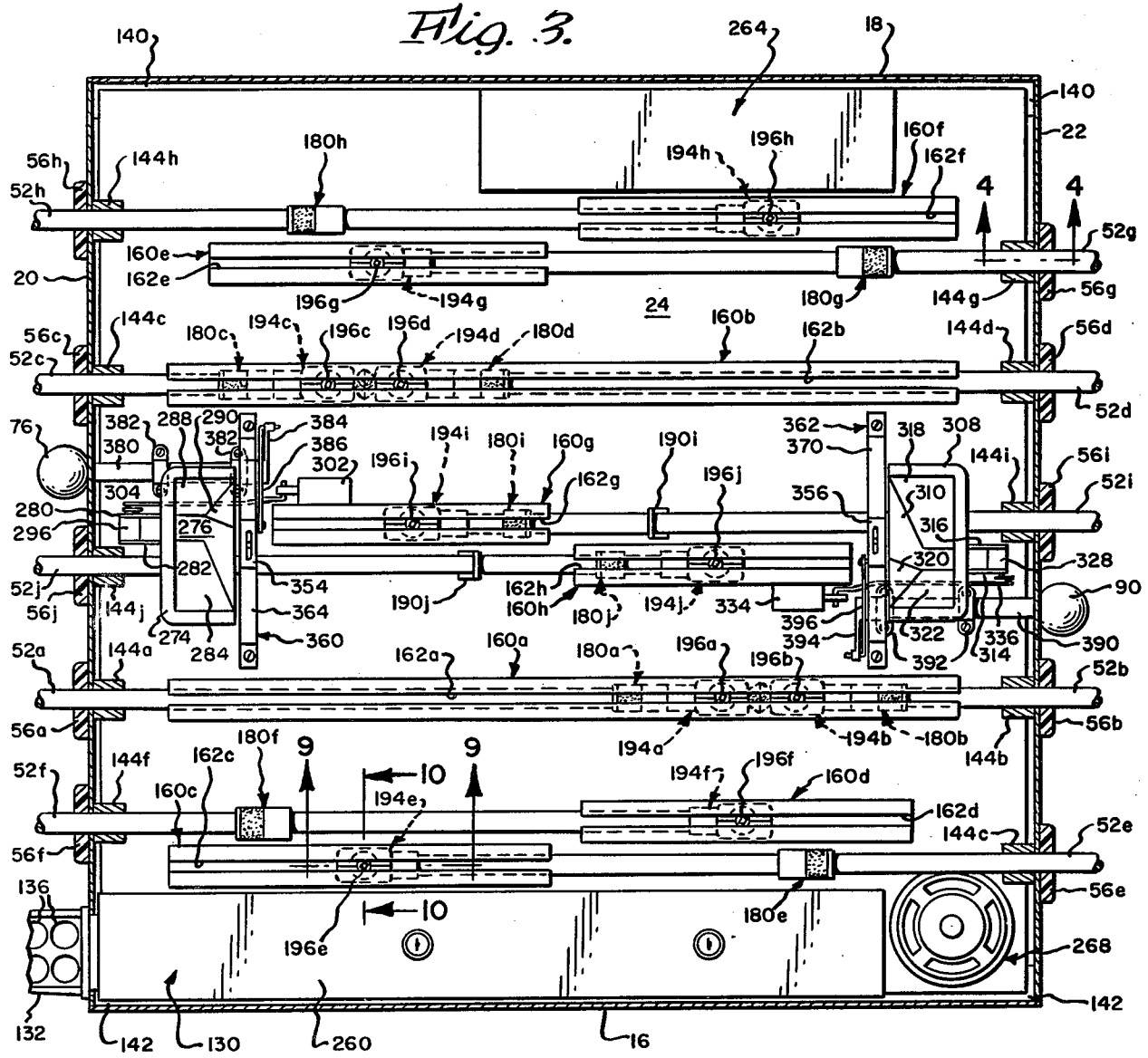
FIG. 3 is a sectional view taken about on line 3—3 in FIG. 1.

FIG. 3 shows in further detail the arrangement and construction of the elongated supporting means for the various tracks which supporting means are located below playing surface 14 together with the means for moving the player elements along the tracks and the coupling elements which are slidable engagement with the supporting means as previously described. Thus, the interior of frame 12 as shown in FIG. 3 is bounded by the side walls 16,18 and end walls 20,22 with the bottom wall 24 being shown as supported by at least two side wall flanges 140,142. The various rod elements 52*a*–52*j* are shown in FIG. 3 extending into the interior of frame 12 and being movably received in the corresponding openings in walls 20,22 and the bumper elements 56*a*–56*j*. FIG. 4 shows in detail one arrangement for securing bumper elements 56 in place, for example bumper 56*g*, which arrangement includes a retainer element 144*g* located on the inner surface of wall 22 having a central opening or passage permitting movement of rod 52 therethrough, and provided with openings through which screws 146 extend for connection through openings in wall 22 to nut-like elements fixed 150 fixed in the bumper 56*g*. As shown in FIG. 3, a plurality of retainers 144*a*–144*j* are positioned on the inner surfaces of walls 20,22 for slidably receiving the corresponding rods 52 and holding the corresponding bumpers 56 in place. The retainers 144 also serve as internal bumpers or stops for the corresponding rods in a manner which will be explained Other arrangements can of course be employed.

In the game shown, the elongated supporting means for the various tracks comprises a hollow, elongated channel-like supporting member 160 for each track and fixed to frame 12 beneath playing surface 14 and positioned in longitudinal alignment with the corresponding slot in the playing surface 14. Each supporting member 160 has a length substantially equal to the length of the corresponding slot in the playing surface, and each supporting member has a slot in registry or communication with the slot in the playing surface. As will be described in further detail presently, each supporting member 160 slidably or movably receives at least one manually-operated means and associated coupling member. Connection between the coupling member and the player element 46 associated therewith is through the aligned slots in the playing surface 14 and the supporting member 160. Thus, the player elements 46 are moved back and forth along the track in response to reciprocation of the corresponding rod 52 and each is rotated about an axis perpendicular to playing surface 14 in response to rotation of the rod as will be described in detail presently.

As shown in FIG. 3, there is an elongated supporting member 160 associated with each slot 44 in the playing surface. In particular, supporting member 160*a* is associated with slot 44*a*, being substantially the same length as slot 44*a*, and receives both the rods 52*a* and 52*b* and their corresponding coupling members in slidable relation therealong. Supporrting member 100*a* has a slot 162*a* in registry ro communication with slot 44*a*. Similarly, a supporting member 160*b* is associated with slot 44*b*, the slot 162*b* of member 160*b* being in registry with slot 44*b* and supporting member 162*b* having a length substantially equal to slot 44*b*. Member 160*b* receives the two rods 52*c* and 52*d* and their associated coupling members in slidable relation therealong. There is a supporting member for each of the relatively shorter slots 44 in the playing surface 14. For example, there is a supporting member 160*c* having a length substantially equal to slot 44*c* and having a slot 162*c* therein in registry with slot 44*c*. Supporting member 160*c* slidably receives the rod 52*e* and its corresponding coupling element. In a similar manner, supporting members 160*d*–160*j* are fixed in frame 12 associated with the corresponding slots 44*d* through 44*j* with the slots of the supporting members in registry with the slots in the playing surface and each of the supporting members slidably receiving therein the corresponding rod and coupling member.

Figures 7, 8, 9, 10, 11, 12:
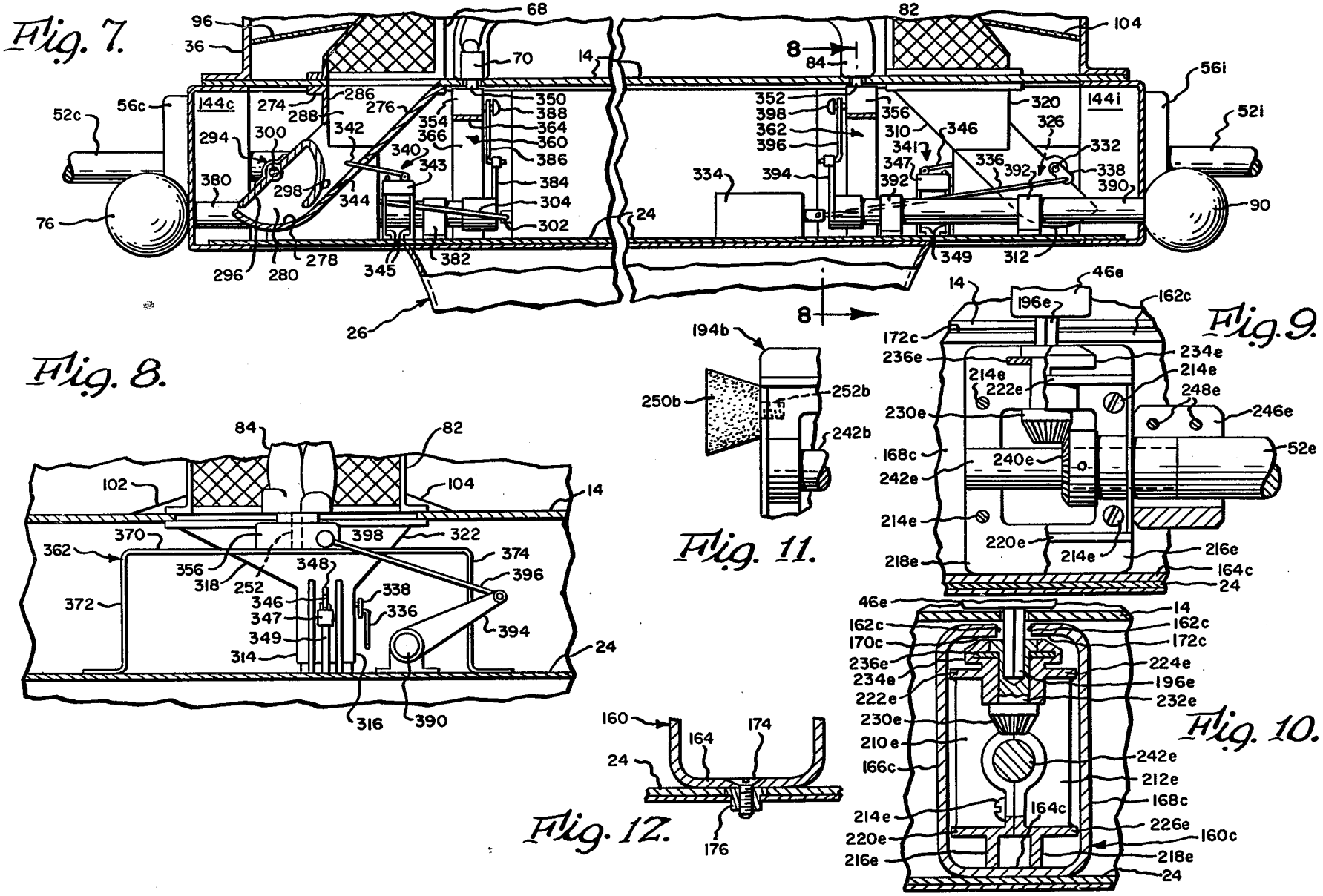
FIG. 7 is a sectional view taken about on line 7—7 in FIG. 2.
FIG. 8 is a sectional view taken about on line 8—8 in FIG. 7.
FIG. 9 is a sectional view taken about on line 9—9 in FIG. 3.
FIG. 10 is a sectional view taken about on line 10—10 in FIG. 3.
FIG. 11 is a fragmentary elevational view of a shock absorbing element on one of the coupling mechanisms.
FIG. 12 is a fragmentary sectional view illustrating the mounting of one of the channel members to the frame bottom wall.

FIGS. 10 and 12 show in further detail one of the elongated supporting members, for example member 160*c* associated with slot 44*c*. The supporting member 160*c* is of substantially hollow rectangular cross section and of one-piece construction having a bottom wall 164*c*, a pair of spaced-apart parallel side walls 166*c*,168*c* extending therefrom which terminate in a pair of top wall portions 170*c* and 172*c* which extend inwardly from the side walls and terminate in spaced-aprat, parallel edges defining the slot 162. The supporting members 160 conveniently can be formed from sheet metal. Other materials and fabrication techniques can of course be employed. The supporting members are fixed to frame 12, in particular to bottom wall 24, by suitable means such as by screw and nut type fasteners 174 and 176, respectively as shown in FIG. 12. Thus, the bottom wall 164 of each supporting member rests on floor 24 and the top wall portions 170,172 are adjacent the inner surface of the top floor or playing surface 14.

Figure 5:
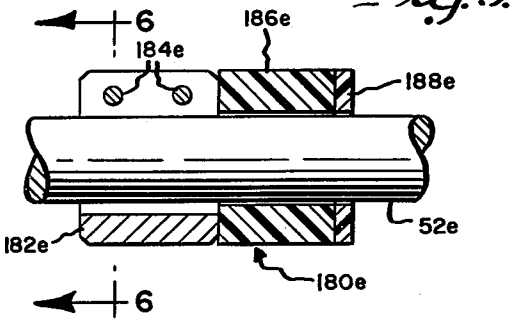
FIG. 5 is a fragmentary sectional view, partly in elevation, of one of the stop members for the rod elements.
Figure 6:
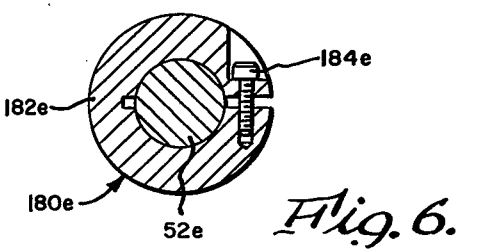
FIG. 6 is a sectional view taken about on line 6—6 in FIG. 5.

The extent of movement of the rods 52 in a direction into the frame 12, i.e. inwardly relative to the corresponding end wall 20,22, is limited by contact between the inner end face of the corresponding hand grip 54 and the outer face of the corresponding bumper element 56 on the end wall. Movement of each rod 52 in a direction outwardly from the frame, i.e. outwardly relative to the end walls 20,22, is limited by stop means carried by the rod members. Most of the rods have a stop member fixed thereto which contacts a corresponding one of the retainer elements 144 to limit the outward movement. For example, referring to rod 52*e* at the lower right-hand portion of frame 12 as viewed in FIG. 3, there is a stop member generally designated 180*e* which is fixed to rod 52*e* and adapted to contact element 144*e* when the rod is withdrawn to the right as viewed in FIG. 3 thereby limiting further outward movement. Stop member 180*e*, as shown in detail in FIGS. 5 and 6, includes a first sleeve 182*e* preferably of metal which is clamped to rod 52*e* by screw type fasteners 184*e*, a second sleeve 186*e* of plastic or similar material, and an outer annular disc or washer-like element 188*e* also of plastic or like material. With the sleeve 182*e* being clamped to rod 52*e* so as to be axially fixed thereon, the sleeve 186*e* and washer 188*e* need not be fixed and can be movable on rod 52*e* thereby providing easier assembly. Identical stop members 190*a*–180*d* and 180*f*–180*j* are provided on the corresponding shafts 52*a*–52*d* and 52*f*–52*j* as shown in FIG. 3. Each of these stop members, in turn, engages the corresponding retainer element 144 to limit outward movement of the corresponding rod. In particular, the washer element 188 of each stop member contacts the corresponding retainer element 144. The two stop members 180*i* and 180*j* on rods 52*i* and 52*j*, respectively, do not engage the elements 144*i* and 144*j* but instead there is provided a pair of stop bracket members 190*i* and 190*j* each fixed to bottom wall 24, extending upwardly therefrom and provided with an opening allowing passge therethrough of the corresponding rod but adapted to contact and hold the corresponding stop element. In the game shown the stop brackets are generally of a right angle configuration with the one leg fixed to bottom wall 24 and the other leg extending therefrom. Thus, stop 180*i* engages bracket 190*i* preventing further outward movement of rod 52*i* to the right as viewed in FIG. 3 and, similarly, stop bracket 190*j* engages stop member 180*j* preventing further outward movement of rod 52*j* to the left as viewed in FIG. 3.

The manually operated means further comprises coupling means carried by each of the rods 52 for converting manual rotation of each rod into a turning or swivelling motion of the corresponding player element 46 about an axis generally perpendicular to playing surface 14. Each coupling means comprises a coupling mechanism generally designated 194 in FIG. 3 for converting rotation of the corresponding shaft into rotation of a shaft or pin member 196 extending through the slots of the track and playing surface for connection to the corresponding player element. Thus, manual rotation of each rod rotates the corresponding pin 196 to rotate the corresponding player element. The coupling mechanisms 194*a*–194*j* connected to rods 52*a*–52*j*, respectively, are shown in FIG. 3 within the associated supporting members 160*a*–160*h*.

One of the coupling mechanisms, for example mechanism 194*e*, is shown in further detail in FIGS. 9 and 10 and includes a housing or body defined by two sections or components 210*e*, 212*e* which are fastened together by screws 214*e* or other suitable fasteners. The housing is generally rectangular in shape having a hollow interior and outer dimensions enabling it to slide along the channel member 160*c* in which it is received. The parts 210*e*,212*e* can be of metal or suitable plastic providing a good sliding relationship with the channel. In addition, a pair of runner-like elements 216*e*,218*e* are formed in the bottom or lower wall for sliding engagement with the bottom 164*c* wall of the channel member shown. Similarly, the side walls of the housing are provided with projections 220*e*, 222*e*, 224*e* and 226*e* for guiding the housing along within walls 166*c*, 168*c* of the channel member 160*c*. The housing contains a pair of bevel gears having their axes disposed at right angles and operatively connected to the player element pin 196*e* and to the corresponding rod 52*e* in the following manner. A first bevel gear 230*e* is located at one end of a shaft like element 232*e*, the other end of which is connected such as by a friction fit, to the pin 196*e*. The shaft 232*e* is rotatably received in a bushing-like formation 234*e* in the upper portion of the housing and an annular washer-like member 236*e* is fitted therein to serve as a suitable bearing. Thus, upon rotation of gear 230*e* the pin 196*e* is rotated which, in turn, causes rotation of the player element 146 attached thereto. The bevel gear 230*e* is in meshing relation with a second bevel gear 240*e* mounted on an internal shaft 242*e* rotatably mounted within the housing for rotation about an axis coincident with that of the rod 52. The internal shaft 242*e* on which gear 240*e* is mounted extends through the housing for connection to the end of rod 52*e* by means of a collar-like clamp 246*e* fastened to rod 52*e* by screws 248*e*.

Thus, rod 52*e* is fixed axially to coupling mechanism 194*e* for sliding it along the supporting member 160*c* to move player element 46*e* back and forth along slot 44*c*. In addition, rod 52*e* is rotatably and operatively connected to mechanism 194*e* whereby rotation of rod 52*e* is connected to rotation of player element 46*e* about an axis perpendicular to surface 14. The other coupling mechanisms 194*a*–194*d* and 194*f*–194*j* are identical in structure and operation to mechanism 194*e*.

The coupling means which are located within the two channels 160*a* and 160*b*, wherein coupling members of opposite rods are in opposed relation, are provided with shock absorbing means operatively associated with the surfaces which abut or impact with the surfaces of the opposed coupling means. For example, coupling means 194*b* is provided on the end face thereof with an element 250*b* of rubber or like shock absorbing material as shown in FIG. 11. The element is connected to the coupling member by a screw 252*b* or like fastening element. As shown in FIG. 3, shock absorber 250*b* on coupling means 194*b* is in opposed, axial alignment with a shock absorber 250*a* on coupling means 194*a* whereby the two contact each other when the players force or urge their respective rods 52*a*,52*b* against each other. In a similar manner, shock absorbers 250*c* and 250*d* are on coupling means 194*b* and 194*d*, respectively, in channel 160*b*. Other shock absorbing means can of course be employed.

A coin-storing housing designated 260 which is part of the coin receiving and storing mechanism 130 is shown in FIG. 3 and extends lengthwise between side wall 16 and the track 160*c* in which rod 52*e* is movable. The container 260 is suitably mounted to bottom wall 24 and includes conventional sensing and circuit means (not shown in FIG. 3) for providing an electrical signal to indicate that the proper number of coins have been inserted whereby play of the game can be initiated. There is also shown in FIG. 3 a housing 264 for containing various electrical control components and circuits associated with the timing, scoring and other operational functions of the game which will be described in detail presently. A loudspeaker generally designated 268 is mounted in the frame 12 located at the lower right hand corner as viewed in FIG. 3 for providing an audible output in response to certain events during play of the game which will be described in detail presently. A sound generator is included within housing 264 and connected by appropriate electrical leads (not shown) within frame 12 to speaker 268 in a conventional manner.

The structure of the two scoring areas 62 and 64 and components associated therewith are shown in further detail in FIGS. 2, 7 and 8. Referring first to scoring area 62 at the left-hand end of playing surface 14 as viewed in FIG. 2, there is provided means in communication with opening 66 for receiving and holding the small, freely movable player piece 60 after a goal is scored during playing of the game. The receiving and holding means is generally in the form of a container or receptacle and includes means for defining an inwardly sloping surface for directing a received player piece 60 from opening 66 in the playing surface 14 into a receiving area beneath the surface. As shown in FIGS. 3 and 7, the receptacle or container-like structure includes an upper peripheral flange 274 for mounting to the lower surface of the playing surface 14 adjacent the opening therein a downwardly sloping wall portion 276 which terminates in a curved lower surface portion 278 defining the receiving and holding area for the player piece 60 after a goal is scored during playing of the game. The receiving and holding area is also bounded by a pair of spaced apart parallel side wall portions 280,282. The receptacle or container also includes a first main side wall portion 284 which extends from the wall 276 and terminates at the lower side wall and joins a generally vertical rear wall portion 286. There is also provided first and second additional side wall portions 288 and 290. In an illustrative game, the lower side walls 280,282 are perpendicular to playing surface 14, wall 276 is disposed at an angle of about 49° with respect to a line perpendicular to surface 14, side wall 284 is disposed at an angle of about 67° to a line perpendicular to surface 14, and each side wall 288,290 is disposed at an angle of about 55° to the line perpendicular to surface 14.

Associated with the scoring area 62 is means in the player piece receiving area for engaging the player piece 60 and propelling it along a return path back up to the playing surface 14. A player piece engaging element generally designated 294 in FIG. 7 has a planar main body portion 296 and a curved player piece engaging surface portion 298. The element 294 is mounted on a shaft 300 which is rotatably mounted in the lower side wall portions 280,282. Movement of the element 294 to propel the player piece 60 outwardly is provided by motive means in the form of a solenoid 302 which operates a rod 304 connected at one end to the plunger of solenoid 302 and at the opposite end through a pivotal connection to a lever arm fixed to shaft 300 as shown in FIG. 3. Solenoid 302 in turn is connected by appropriate electrical leads (not shown) to circuitry within housing 264 as shown in FIG. 3.

In a similar manner the scoring area 64 at the opposite end of playing surface 14 includes a player piece receiving and holding means in the form of a container or receptacle having an upper peripheral flange 308, a downwardly sloping wall 310, a curved lower portion 312 which is bounded by a pair of lower side walls 314,316. There is a first upper side wall 318 a rear wall 320 and a pair of additional side walls 322 and 324. The various walls are disposed at the same angles described in connection with the foregoing illustration of scoring area 62. There is also an identical player piece engaging and propelling element 326 including a planar main body portion 328 and a curved operative surface portion 330. The element 326 is mounted on a shaft 332 rotatably received in the lower side wall portions 314,316. The element 326 is operated by motive means in the form of a solenoid 334 connected thereto through a rod 336 and a lever arm 338 in a manner similar to that of the other scoring area.

The game of the present invention further comprises first and second sensing means 340 and 341 associated with the first and second scoring areas, 62 and 64, respectively, for providing a signal when the player piece 60 is in the respective scoring area. In particular, and referring to FIG. 7, a score sensor operatively associated with the scoring area 62 at the left-hand end of surface 14 as viewed in FIG. 7 is generally designated 340 and is in the form of a micro-switch having a switch arm 342 movably connected at one end to a switch housing 343 and extending through an opening 344 provided in wall 276 of the player piece receiving area, the switch housing 343 being supported on bottom wall 24 by means of legs 345. Thus, when a goal is scored, player piece 60 in traveling down along wall 276 contacts the outer end of switch arm 342 and moves it to operate the switch. The contacts associated with switch housing 343 are connected by leads (not shown) to electrical circuitry within housing 264 in a manner which will be described. Similarly, a score sensor operatively associated with the scoring are 64 at the right-hand end of surface 14 as viewed in FIG. 7 is generally designated 341 and is in the form of a micro-switch having switch arm 346 movably connected at one end to a switch housing 347 and extending through an opening 348 provided in wall 310 of the player piece receiving area, as shown in FIG. 8, the switch housing 347 being supported on bottom wall 24 by means of legs 349. Thus, when a goal is scored, player piece 60 in traveling down along wall 310 contacts the outer end of switch arm 346 and moves it to operate the switch. The contacts associated with switch housing 347 are connected by leads (not shown) to electrical circuitry within 264 in a manner which will be described.

Each of the goalie simulating player elements designated 70 and 84 in FIG. 2 is movable laterally in opposite directions across the goal scoring area in response to manual rotation of the corresponding knobs 76 and 90, respectively. There is provided means for converting rotation of the knobs into longitudinal reciprocating movement of the corresponding player element. In particular, and referring to FIGS. 7 and 8, each goalie element 70 and 84 is provided with a pin or rod-like connecting element 350 and 353, respectively which extends through the corresponding slot 72 and 76, respectively, in the playing surface 14 and is fixed to a solid rectangular-shaped block member designated 354 and 356, respectively, in FIG. 7. Each block 354,356 is located below the playing surface 14 and is freely movable along a supporting member in the form of a bracket 360 and 362, respectively, which in turn is fixed to the bottom wall 24. In particular, bracket 360 has a base portion 364 and a pair of leg portions extending at right angles thereto, one of which is designated 366, by which it is fixed to bottom wall 24. Similarly, and as shown in detail as in FIG. 8, bracket 362 has a base 370 and a pair of legs 372,374 extending at right angles thereto and terminating in feet portions which are fixed to bottom wall 24 as shown in FIG. 8. Thus the blocks 354 and 356 are slidable back and forth across the upper surfaces of base portions 364 and 370 of brackets 360 and 362, respectively. Knob 76 is connected to one end of a rod or shaft 380 which extends through an opening in end wall 20 and which is rotatably received in a pair bearing-like supporting elements 382 mounted on bottom wall 24. The opposite end of rod 380 is fixed to one end of a lever arm 384, the other end of lever arm 384 is pivotably connected to a rod 386, and the other end of rod 386 is pivotably connected such as by means of a pin 388 to the block 354. In a similar manner, and as shown in FIG. 8, knob 90 is connected to one end of a rod 390 which extends through an opening in the end wall 22 and is rotatably received in a pair of bearing-like supporting elements 392 mounted on bottom wall 24. The opposite end of rod 390 is fixed to one end of a lever arm 394, the other end of lever arm 394 is pivotably connected to a rod 396, and the other end of rod 396 is pivotally connected by a pin 398 to block 356. Accordingly, upon rotation of either of the knobs 76 or 90 the corresponding shafts 280 or 390 are rotated to move the lever arms and reciprocate the corresponding blocks 354 or 356 along the bracket bases 364,370 to move the goalie members laterally across the scoring area. This in turn enables a person playing the game to attempt to prevent a goal being scored by his opponent as in the playing of regular hockey.

Figure 16:
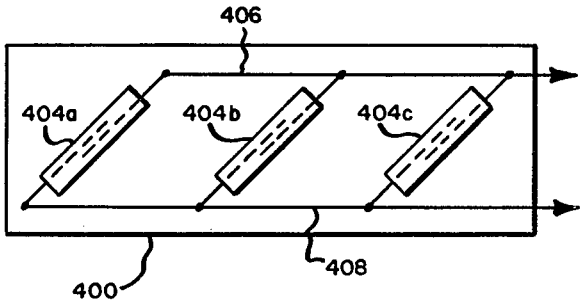
FIG. 16 is a schematic diagram of one of the near miss sensors shown in FIG. 2.

The game of the present invention further comprises sensing means located adjacent each of the scoring areas 62,64 for indicating when the player piece 60 is moved into that adjacent area but not through the opening to provide a score. In other words, a "near-miss" situation is sensed. In particular, and as shown in FIG. 2, the two sensing means are generally designated 400 and 402. Each is located slightly in front of the goalie simulating player element 70,84 and extends laterally across the width of the respective scoring area. Each sensing means 400,402 is located beneath the playing surface 14. Referring now to FIG. 16, the sensing means 400 comprises a plurality of reed switches 404*a*,404*b* and 404*c* connected in parallel by conductors 406,408 for connection to the game circuitry in housing 264 in a manner which will be described. The switches 404 are mounted on a board defining the approximate sensitive area of the sensing means 400. The board, in turn, is mounted in a suitable manner beneath playing surface 14. The sensing means 402 is of identical construction. The player piece element 60 includes magnetic material which causes the switch members to close and complete an electrical circuit to signal a "near miss" event.

Figure 14:
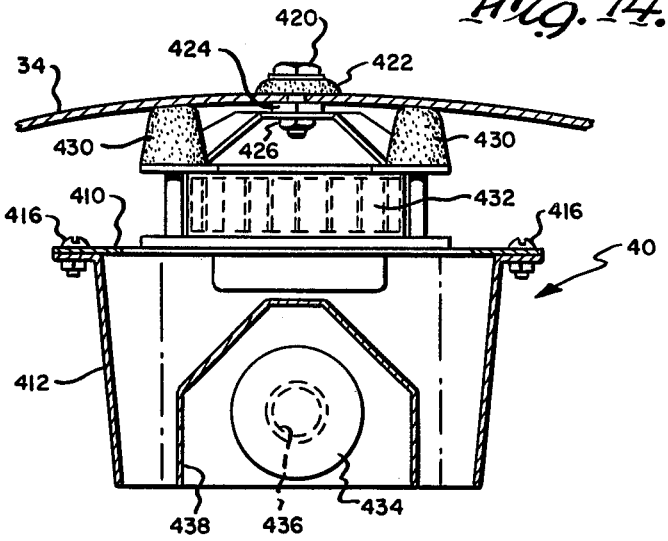
FIG. 14 is a fragmentary sectional view, partly in elevation, of the scoreboard structure shown in FIG. 1.
Figure 17:
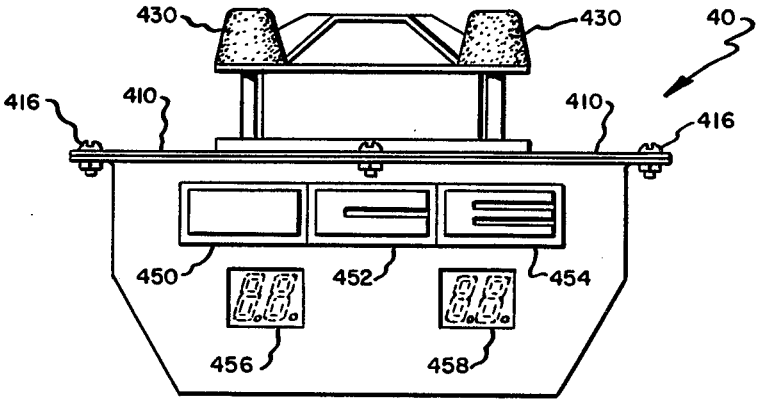
FIG. 17 is an elevational view further illustrating the scoreboard structure shown in FIG. 1.

FIGS. 14 and 17 illustrate in further detail the scoreboard simulating element designated 40 in FIGS. 1 and 2. It is of generally hollow rectangular shape including a top wall 410 and a plurality of side walls, two of which are designated 412 and 414 in FIG. 14, joined together by suitable fasteners 416, such as the screw and nut type. The top wall 410 is spaced from the dome 34 and there is a spider-like structure therebetween which is fastened to the dome by a single fastener in the game shown, the fastener comprising a bolt 420, outer resilient washer 422, inner washer 424 and nut 426. Associated with the top wall structure are a plurality of cushioning elements 430 of resilient material which are fixed to the score board structure and contact the inner surface of dome 34. The top wall structure also includes a housing containing a fan 432 for cooling electronic components in the interior of the scoreboard structure which also contains a lamp 434 received in a socket 436 and located within a polished metal reflector element 438. Electrical power for operating fan 432 and lamp 434 and electrical signals for operating other components in scoreboard element 40 is supplied by suitable electrical conductors (not shown) leading to appropriate locations in frame 12, and these conductors can be incorporated in a ribbon-like conductor 440 as shown in FIGS. 1 and 2 leading from scoreboard 40 along the inner surface of dome 34 to frame 12. Light from lamp 434 shines through the open bottom of the scoreboard structure for illuminating the playing surface 14 below.

On at least one of the outer surfaces of the scoreboard simulating element 40 as shown in FIG. 17, there is provided time indicating display elements in the form of the plurality of displays 450,452 and 454. In a game simulating hockey, the three display elements can be used to signal the three regulation scoring periods in a game in a manner which will be described. The scoreboard simulating element 40 also is provided with a pair of numerical display elements 456 and 458 for indicating the numerical scores of the two teams represented by the movable player elements in a manner which will be described. By way of example, in an illustrative game, displays 456 and 458 can be General Instrument MAN 6740 double digit segment displays.

Figure 18:
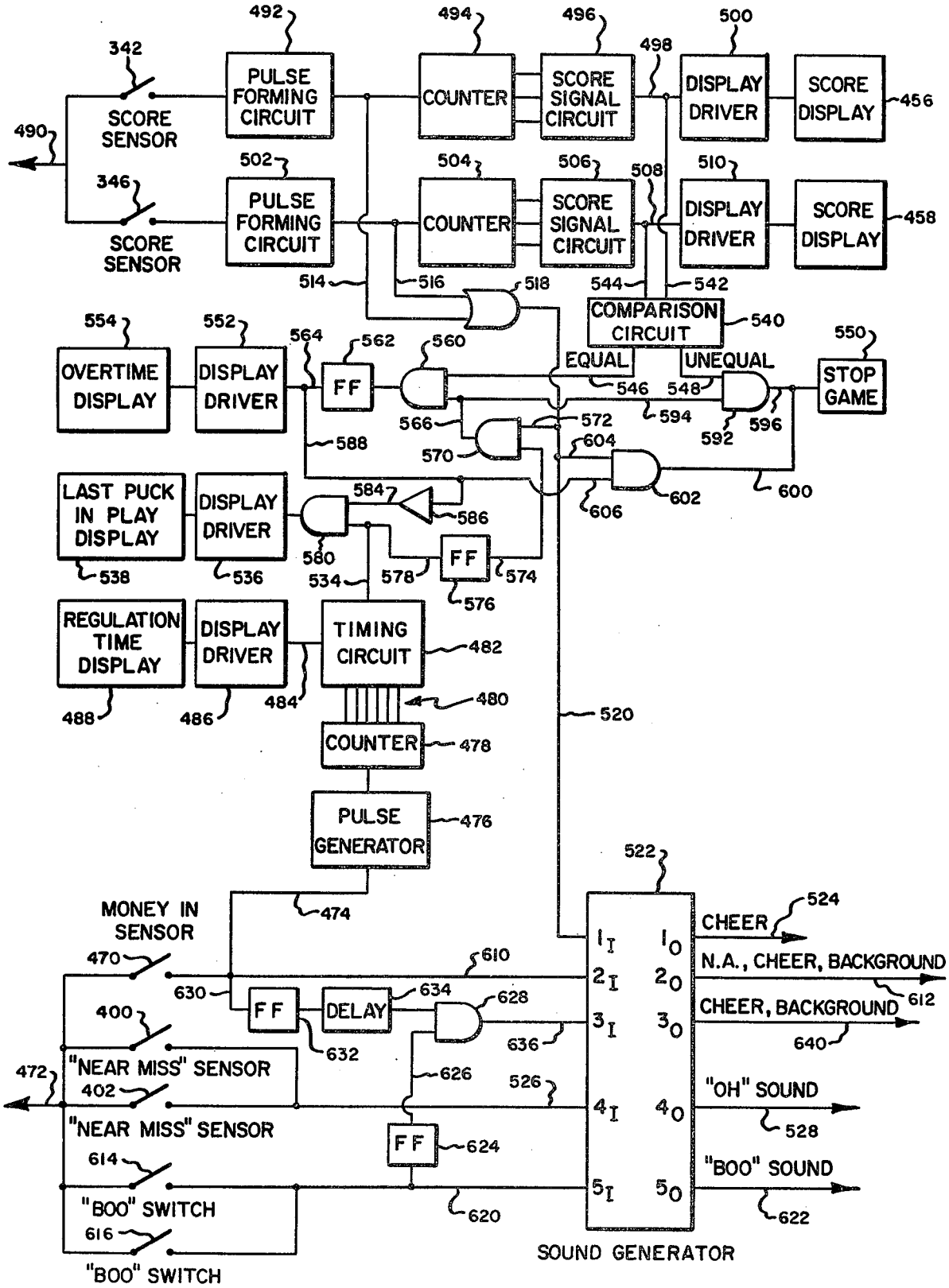
FIG. 18 is a schematic block diagram of a control circuit for the game of the present invention.

FIG. 18 is a schematic block diagram of the timing and control circuit of the game of the present invention. The circuit is placed into operation by closing of a switch 470 operatively associated with the coin receiving and storing means 130 which is closed when the proper predesignated number and/or denomination of coins is inserted by a person seeking to play the game. Closing of switch 479, also identified as the "Money In Sensor" in FIG. 18, completes a circuit from a source of supply voltage on line 472 through a line 474 to a timing means which comprises a pulse generator 476 for providing timed output pulses to the input of a binary digital counter 478 which, in turn, provides output signals on the lines generally designated 480 which are connected to a timing circuit 482. One output of timing circuit 482 is connected by a line 484 to a display driver circuit 486, which, in turn, is connected to a circuit 488 for operating the time displays 450,452 and 454 in a manner indicating to persons playing the game that the time still is within the regulation time period. For example, circuits 482,488 can function to operate the first time display 450 for the first one-third or period of the total regulation time, then to operate display 454 for the second one-third or period, and finally to operate display 454 for the remaining one-third or final period. Of course, various other modes of operation can be selected. The overall length of time during which the game can be played for a given money input is determined by the timing circuit 482 in response to the pulse count input thereto and is preset during manufacture of the game.

The circuit of FIG. 18 also is operatively connected to the score sensors 340 and 341 in the two scoring areas 62 and 64, respectively, for providing signals when the player piece 60 is received in the scoring area in a manner causing a score. The two switch arms 342 and 346, of the sensors 340 and 341, respectively are shown in FIG. 18, and when the player piece element 60 travels down the sloping surface to move the switch arm in the manner previously described, the corresponding sensor switch is closed to complete a circuit from a source of voltage connected to line 490 to scoring means operatively connected to the first and second sensing means 340,341 for converting signals from the sensors 340,341 into scores associated with the respective players. In particular, the switch arm 342 of score sensor 340 when closed completes a circuit from line 490 to the input of a pulse forming circuit 492 for providing a pulse in response to each score. Circuit 492, in turn, is connected to the input of a digital counter 494 for counting the pulses from circuit 492 representative of scores or goals. The output count is applied to a score signal circuit 496 for converting signals representative of the count into an analog signal applied by a line 498 to the input of a display driver circuit 500. Circuit 500, in turn, provides signals to the one score display 456 on the scoreboard for providing a cumulative numerical display representative of the number of counts, which, in turn, represents the number of goals scored during play of the game. In a similar manner, switch arm 346 of score sensor 341 completes a circuit from line 490 to a pulse forming circuit 502 which is connected to the input of a counter 504 which operates a score signal circuit 506 connected by a line 508 to a display driver 510 for operating the other score display 458. In other words, the combination converts each pulse representative of a goal scored into an equivalent cumulative numerical quantity representative of the total score which is displayed by element 458. Thus, during play of the game, each time player piece 60 is moved by a player element 46 into either scoring area 62,64 in a manner scoring a goal, the numerical quantity on the corresponding display 456,458 is increased by one.

The game of the present invention further comprises means for generating sound of a first type in response to a scoring event such as when the player piece element is propelled into the scoring area causing operation of either of the score sensors 344,345. To this end, the outputs of the pulse forming circuits 492,502 are connected by lines 514 and 516 to the inputs of an OR gate 518, the output of which is connected by a line 520 to the input of an electrically operated sound generating means 522. Sound generating means 522 can be of various commercially available types, and one found to perform satisfactorily is available commercially from National Semiconductor Corp. and identified as MM 54104 Digitalker Speech Synthesis System. For a more detailed description of the structure and operation of such system, reference may be made to National Semiconductor Corp. product literature entitled "MM 54104 Digitalker Speech Synthesis System" dated November 1980 pages 1–8 and National Semiconductor Application Note 252 entitled "Speech Synthesis" dated December 1980 no. AN-252 pages 1–12, the disclosures of which are hereby incorporated by reference. The output line 524 represents the audible cheer output. The sound generating means 522 also has the capability of providing a sound of a second type in response to operation of either of the "near miss" sensors 400,402. In this connection operation of either of the sensors completes a circuit from line 472 through a line 526 to another input of the sound generating means 522. The output line 528 represents the audible output, also designed the "Oh" sound.

In the game of the present invention, the time indicating display means has a first state indicating regular playing time which corresponds to operation of the portion of the circuit designated 488, a second state indicating the near-end of playing time and a third state indicating an overtime game situation. The second state, indicating near end of playing time, also is designated "last puck in play" and to this end timing circuit 482 has another output on line 534 which through other components of the circuit operates a display driver 536 and a circuit portion 538 for operating the displays in a "last puck in play" mode. By way of example, in this mode all three displays 450,452 and 454 could be operated on and off simultaneously. In this mode the next score will end the game unless there is a tie in which case there will be a third state or overtime situation.

For determining whether the next goal scored should result in ending of the game or advancing to the overtime situation, the game of the present invention further comprises score monitoring and comparing means operatively connected to the score sensing means and to the timing means for providing, during the second state, a first output signal indicating the inequality of the scores and a second score output signal indicating the equality of the scores. In particular, a comparison circuit 540 is provided and the pair of intputs thereto are connected by lines 542 and 544 to the lines 498 and 508, respectively, from the outputs of the two score signal circuits 496 and 506. The outputs of those circuits 496,506 provide an instantaneous indication of the total score of the two players or teams. Accordingly, circuit 540 determines whether these quantities are equal or unequal and provides corresponding output signals on lines 546 and 548. When a signal is present on line 548 indicating that the scores are unequal, a winner of the game has been established and the game should be stopped. The circuit of FIG. 18 then functions to operate a control circuit designated 550 which serves to stop the game. On the other hand, when there is a signal on line 546 the scores are equal after the "last puck in play" mode and since there is no winner, the game advances to the overtime mode. Accordingly, the circuit of FIG. 18 functions to operate a display driver circuit 552 and overtime display circuit 554. For example, circuit 554 could operate the three display elements 450,452 and 454 on and off sequentially to indicate the overtime situation. Other modes can of course be employed.

Referring now to the detailed circuit shown in FIG. 18, the output line 546 from comparison circuit 540 is connected to one input of an AND gate 560, the output of which is connected to the input of a flip-flop circuit 562, and the output of flip-flop 562 is connected by line 564 to the input of display driver 552. The other input of AND gate 560 is connected by a line 566 to the output of an AND gate 570. One input of AND gate 570 is connected by line 572 to line 520 on which a signal is present every time a score occurs. The other input of AND gate 570 is connected by a line 574 to the output of flip-flop 576, the input of which is connected by line 578 to output line 534 from the timing circuit 482. Lines 534 and 578 also are connected to one input of an AND gate 580, the output of which is connected to display driver 536. The other input of AND gate 580 is connected by a line 584 to the output of an inverter 586, the input of which is connected by a line 588 to the output of flip-flop circuit 562.

Lines 548 from the "unequal" output of comparison circuit 540 is connected to one input of an AND gate 592, and the other input of AND gate 592 is connected by a line 594 to line 566 from the output of AND gate 570. The output of AND gate 592 is connected by a line 596 to the input of the stop game circuit 550. Another input to the stop game circuit 550 is present on line 600 connected to the output of an AND gate 602. One input of AND gate 602 is connected by line 604 to line 520 on which a signal is present everytime a score occurs. The other input of AND gate 602 is connected by line 606 to line 588 from the output of flip-flop 562.

Thus, when timing circuit places an output on line 534, and when the game is not in the overtime mode as signalled by the absence of a signal on line 588 converted by inverter 586 to a logical one signal level on line 584, the combination of display driver 536 and circuit 538 is operated to signal the last puck in play mode as previously described. The output signal on line 534 is held by flip-flop 576 and a logical one signal is maintained on line 574 to one input of AND gate 570. The next time a goal is scored during this mode of play of the game, a signal is present on line 520 with the result that both inputs to AND gate 570 are logical one levels thereby providing a logical one level through lines 566 and 594 simultaneoulsy to one input of each AND gate 560 and 592. If this goal results in unequal scores as signalled by an output on line 548 from comparison circuit 540, the two logical one inputs to AND gate 592 cause it to operate the stop game circuit to stop the game because a winner has been determined. On the other hand, if this goal results in equal scores as signalled by an output on line 546, the two logical one inputs to AND gate 560 cause it to operate flip-flop 562 which, in turn, causes operation of the combination of display driver 552 and overtime display 554 to signal the overtime mode as previously described. The output of flip-flop 562 is held and applied by lines 588 and 606 to one input of AND gate 602. The next time a goal is scored during this mode of play of the game, a signal is present on line 520 with the result that both inputs to AND gate 602 are logical one levels causing it to operate the stop game circuit 550 to conclude the game.

In the game of the present invention additional sounds are provided by sound generator 522 in the following manner. At the beginning of the game there can be a sequence of a portion or all of the National Anthem, a cheer of a lower level than that of a scoring cheer, and background noise. This sequence is initiated by means of a line 610 connected to one of the sound generator inputs and connected through the "money in sensor " switch 470 to line 472. The sequence of output sounds is indicated on the line designated 612. Either player during the course of the game can initiate a booing type of sound produced by generator 522. To this end a pair of switches designated 614 and 616 in FIG. 18 are provided at readily accessible locations on frame 12 (not shown) and are connected in parallel between line 472 and a line 620 leading to another input of sound generator 522. The output sound is indicated on line 622 leading from generator 522. In addition, the circuit of FIG. 18 includes the capability of circumventing the National Anthem portion of the sound at the beginning of the game, if desired. The result is simply a cheer and background noise. This is controlled by either of the switches 614,414. In other words, operation of either of these switches at the beginning of the game when the switch 470 is operated will result in elimination of the National Anthem portion. To this end, line 620 is connected to the input of flip-flop 624, the output of which is connected by a line 626 to one input of an AND gate 628. Switch 470 is connected by a line 630 to the input of a flip-flop circuit 632, the output of which is connected through a delay 634 to the other input of AND gate 628. The output of AND gate 628 is connected by line 636 to the input of sound generator 522 which provides the cheer and background sequence on the output line 640.

As previously described, sound generating means 522 can comprise a National Semiconductor synthesizer MM54104 together with eight read-only memories of the National Semiconductor MM52164 type. There can be five different sounds in the following descent order of priority: National Anthem, cheer, oh sound, boo sound and background crowd noise. Preferably the National Anthem and background sounds are at relatively lower levels and the remaining sounds are at higher levels. The sound synthesis can be organized into second, for example four, groups with the types and levels of the various sounds being selected by addressing the ROMs.

The National Anthem is played only once after the money has been inserted. The National Anthem is about 20 seconds long, and no other sounds can interrupt the National Anthem. However, operation of either boo switch 614,616 can be used to cancel this sound at the start of the game as previously described. The cheer sound can be activated two different ways. First, it can be played immediately after the National Anthem. The cheer can have different lengths with a shorter version of the cheer being played after the National Anthem. The second way the cheer is activated is when the puck is detected in either puck chute, and at this time the full cheer is played. The cheer has the highest priority of sounds when the game is being played. If any other sound is being played such as an Oh, boo or background and the puck is detected in the chute, the cheer overrides these other sounds. The foregoing is determined by selection of various ROMs of the sound generating means 522.

The oh sound is generated by one of two sensors 400,402 located in front of each puck chute in the goal crease area as shown in FIG. 2. When the puck is detected in this area, an oh sound is generated. Sound generating means 522 has the capability of providing several different oh sounds and in a random type manner of generation. For example, if the puck is detected in the goal crease area, then leaves area and comes back in and is detected again, an oh is generated for the first detection and a new sound is generated for the scond detection whether the first oh is complete or not. In other words, an oh sound can interrupt another oh sound, no matter what stage the first oh sound is in. The oh sound has the second highest priority of sounds when the game is being played. Only the cheer sound can interrupt an oh sound, and the oh sound can interrupt either the boo or background sounds.

The boo sound is provided in response to manual operation of either of the switches 614,616 located at both ends of the game as previously described. The boo sound can be activated only three times per end, per side. That is each team or player gets to activate the boo sound three times during a game. The boo sound has the third highest priority and can be interrupted by the cheer or oh sounds and can interrupt the background sound. The background sound is used to simulate the crowd noise found in an auditorium. This sound can be approximately 3 seconds long and is continously repeated to produce the effect of the crowd noise. The cheer, oh, and boo can all interrupt the background sound. The various selections, priorities and portions of sounds are accomplished by the electronic sound synthesizer and addressable ROMs previously identified.

Electrical power for operating the game is obtained from a convenitonal outlet through a plug and cable (not shown) leading to frame 12. There is a power supply (not shown) within frame 12 for connecting the line a.c. into the various electrical quantities needed by the game, for example the voltages on lines 472 and 490 in FIG. 18 as well as those for operating the displays, indicators, and sound generating means. The line a.c. can be supplied directly to fan 432 and lamp 434 inthe scoreboard through ribbon conductor 440.

The game 10 of the present invention operates and is played in the following manner. The game is a coin-operated, electromechanical amusement game to be played by at least two persons, and the game shown simulates the playing of hockey. The playing surface 14 can be approximately 32" wide by 38" long and simulates a hockey rink, complete with ice markings and "boards" around the perimeter that can include display advertising. As shown in FIG. 2, four face-off circules 652, 654, 656 and 658 are marked on surface 14 together with a center line 660, two blue lines 662,664 and two red lines 666,668. The rink is completely encased in the scratch-resistant Lexan dome 34. The plastic player elements 46 and goalie elements six pere tem, are molded from high strength valox or like material. Each player element 46 can be moved longitudinally along a corresponding slott 44 on a specific segment of the ice surface and can simultaneously be rotated 360° to shot or pass the puck 60. Players 46 are manipulated by the movement and rotation of the fiberglass rods 52 protruding from the ends 20,22 of the frame 12. Two "men" on each team are situated in the same slot as their counterparts on the opposing team and can physically interfere with one another, or "check", as occurs in an actual hockey game. In particular, this includes the player elements 46a,46b movable along slot 44a and the player elements 46c,46d movable along slot 44b. This feature adds a physical dimension to the play of the game for the "human" players who control the movement of the rods 52. The puck 60 remains in the confines of the game and is automatically ejected from either scoring area 62,64 at the start of a game and after each goal is scored.

The mechanical play of game 10 is supported by a number of electronic features. These features serve to heighten the excitement of playing and observing game 10 and enhance the visual attractiveness thereof. They are as follows.

The scoreboard and period indicator 40 affixed on the underside of the ceiling of dome 34. The dome lamp 434 which illuminates the playing surface 14. A segment of the National Anthem played after insertion of money into mechanism 130. Electronically synthesized background noise during the entire game, cheering for approximately 7 seconds after a goal is scored ooohhs sounds for approximately 3 seconds when the puck 60 enters the goal crease area, and boos sounds generated by manual activation of the "anti-stall" buttons or switches 614,616. Electronically timed play including 5 minute regulation play, last puck in play mode and overtime play mode in the event of a tie. The electronically synthesized sound is produced by the sound generating means 522 previously described and which is located in housing 264 and the speaker 268 is connected to sound generating means 522 by appropriate conductors in frame 12. In other words, the audible output sounds produced by generator 522 are emitted from speaker 268. The timing and scorekeeping functions are provided by scoreboard 40 under control of circuitry as shown in FIG. 18 and which also is located in housing 264.

When the electrical supply cord of game 10 is plugged in to a standard electrical outlet, the lamp 434 and fan 432 are turned on, the displays 456,458 set to 00, and the indicators 450,452 and 454 remain off. The coin mechanism 130 then monitors for money to be inserted. When exact amount of money is inserted, switch 470 is closed and the National Anthem plays followed immediately by 50% of the cheer, regulation time starts after the National Anthem and the indicator 450 comes on. The puck 60 is ejected onto surface 14 right after the cheer sound. Only the indicator 450 stays on for the first $\frac{1}{3}$ of regulation time, then only the indicator 452 comes on for the next $\frac{1}{3}$ of regulation time and only the indicator 454 comes on for the last $\frac{1}{3}$ of regulation time. During play of the National Anthem either boo switch 614,616 located on the ends 20,22 of the game, can be activated to cancel the National Anthem and just play 50% of the cheer. Immediately after the cheer, the background sound is played over and over again to simulate the crowd noise at an auditorium. The game is then played with the electronics monitoring regulation time and any sounds to be activated. The boo sound is manually activated and can be used three times a game by each player or team. The oh sensors 400,402 located under the ice surface in the goal crease area, cause generation of the oh sound. The oh sensors 400,402 can only be activated by the puck 60.

When a player or team scores a goal, the puck 60 enters either of the openings 66,80 of the scoring areas and travels down the structure previously described and moves either of the switch arms 342,346 to register a goal. When this happens one is added to the respective socre and a cheer is played. The puck is then ejected from the scoring area by operation of the appropriate propelling element 294,296 for continued playing of the game.

The last puck in play mode occurs immediately after regulation time and is signalled by the indicators 450,452 and 454 all flashing simultaneously. Last puck in play means that the next puck that is scored will end the game so long as it doesn't create a tie score. If the score in last puck in play mode creates a tie, the game then goes into the overtime mode. This mode is indicated by the indicators 450,452 and 454 going on and off sequentially. The next score then will end the game. All game features remain the same in these last two modes. That is, the boos may still be played, the oh sensors 400,402 are still active and the scoring sequence is still the same.

The game ends when a score is made in last puck in play mode with no tie or with a score in overtime. When the game ends the score of the game remains displayed and the indicators are turned off. The boo switch, oh sensor and puck chute sensor cease to function. The game then awaits another activation in response to proper coins being inserted in mechanism 130 to operate the money in sensor 470.

The checking feature provided by the opposing player elements 46a, 46b, and the opposing player elements 46c,46d adds a physical dimension to the game for the persons who control movement of the rods 52a, 52b and 52c,52d. The realism provided by this feature is enhanced by the timing and scorekeeping functions, the generation of different sounds in response to various events during play of the game, and the transparent dome 34 enclosing playing surface 14 and supporting scoreboard 40 in suspended relation over surface 14. In addition to the foregoing, the game is challenging, being truly a game of skill and co-ordination on the part of persons playing the game, rather than being merely a game of chance. The pace of the game is determined by the skill level of the players, and the regulation time period is uniform, regardless of the skill level of the players. The concepts of the game also as readily adaptable to other sports such as football, soccer, lacrosse and polo, to mention a few.

It is therefore apparent that the present invention accomplishes its intended objects. While embodiments of the present invention have been described in detail, that is for the purpose of illustration, not limitation.

We claim:

1. In a game of the type simulating a spectator sport wherein player elements are operated to move a player piece along and over a playing surface into either of two scoring areas to result in a score:

(a) first and second sensing means each operatively associated with one of said scoring areas for providing a signal when said player piece is in the respective scoring area;

(b) scoring means operatively connected to said first and second sensing means for converting signals from said sensing means into scores associated with players of said game;

(c) time indicating display means having a first state indicating regular playing time for the game, a second state indicating a near-end condition of the game playing time, and a third state indicating an overtime condition of the game playing time;

(d) timing means operatively connected to said time indicating display means for controlling the duration of said first state and for causing switching to said second state;

(e) score monitoring and comparing means operatively connected to said scoring means and to said timing means for providing during said second state a first output signal indicating inequality of said scores and a second output signal indicating equality of said score;

(f) means operatively connected to said score monitoring and comparing means for utilizing said first output signal to cause stoppage of said game; and (g) means operatively connected to said score monitoring and comparing means and operatively connected to said time indicating display means for utilizing said second output signal to switch and display means to said third state.

2. A coin operated game apparatus of the type simulating a spectator sport, comprising:

a playing surface, a plurality of player elements located above and moveable relative to said playing surface, a playing element moveable relative to said playing surface upon movement of said player elements, a goal area having an opening communicating with a passage receiving said playing element resulting in a score, a first electrical sensing means sensing the receipt of said playing element in said goal opening, a clear plastic dome enclosing and hermetically sealing said playing surface, a score indicating electrical display means within said dome and spaced from said player elements, said first sensing means connected to the input of said score indicating display means for displaying the number of goals scored upon receipt of said playing element in said goal opening, a playing element ejector means receiving said playing element from said goal opening and passage adapted to eject said playing element onto said playing surface, spaced from said goal opening and within said hermetically sealed dome, said dome thereby preventing access by the players of said game apparatus to said player and playing elements, a sound generating means, and a second electrical sensing means located adjacent said goal opening connected to the input of said sound generating means, said second sensing means adapted to sense the presence of said playing element adjacent said goal opening and actuate said sound generating means, indicating the presence of said playing element adjacent said goal opening.

3. The coin operating game apparatus defined in claim 2, characterized in that said playing element including a magnetic material generating a magnetic field, said second sensing means having a normally open electrical switch located adjacent said goal opening below said playing surface, said second sensing means normally open switch connected to the input of said sound generating means, said normally open switch closing upon receipt of said magnetic playing elements on said playing surface generally over said switch, thereby actuating said sound generating means and indicating a presence of said playing element adjacent said goal opening.

4. The coin operated game apparatus defined in claim 3, characterized in that said game apparatus includes a third sensing means having a normally open electrical switch in said goal passage connected to a second input of said sound generating means, said playing element adapted to close said third sensing means switch, actuating said sound generating means, thereby indicating the receipt of said playing element in said goal opening.

5. The coin operated game apparatus defined in claim 3, characterized in that said second sensing means includes a plurality of said normally open switches, with each switch extending at an angle to the entrance of said goal area, said second sensing means thereby sensing the presence of said magnetic playing element adjacent said goal opening.

6. The coin operated game apparatus defined in claim 2, characterized in that said playing surface includes a plurality of inclined ramp surfaces which maintain said playing element in the field of play for engagement by said player elements within said hermetically sealed dome.

7. A preprogrammed coin operated game apparatus, comprising: a frame, a playing surface supported on said frame, a plurality of player elements supported above said playing surface and moveable relative to said playing surface, a playing element moveable on said playing surface in response to the movement of said player elements, a goal having an opening communicating with a passage receiving said playing element resulting in a score, a clear plastic dome enclosing and hermetically sealing said playing surface, a plurality of manual control means extending from said frame connected to said player elements and adapted to move said player elements relative to said playing surface, a game apparatus control circuit means, an ejector means receiving said playing elements froms said goal opening and passage, said ejector means ejecting said playing element onto said playing surface spaced from said goal opening upon actuation of said control circuit means to start the operation of said game apparatus, an audio generating means, a coin operated actuation delay circuit connected to the input of said audio generating means, said delay circuit adapted to actuate said audio generating means to provide an initial audio transmission upon receipt of a coin, and a manually actuated priority switch connecting said actuation delay circuit to said game apparatus control circuit means to override said delay circuit, stop said initial audio transmission and actuate said ejector means to eject said playing element onto said playing surface and begin the play of said game apparatus.

8. The preprogrammed coin operated game apparatus as defined in claim 7, characterized in that said audio generating means has at least two inputs each generating different sounds and said game apparatus including a first sensing means having a normally open electrical switch located below said playing surface connected to one of said audio generating means inputs, said playing element including a magnetic material generating a magnetic field and closing said sensing means switch when said playing element is located generally above one of said switches, thereby actuating said audio generating means.

9. The preprogrammed coin operated game apparatus defined in claim 8, characterized in that said first sensing means is located adjacent said goal opening and includes a plurality of normally open switches extending at an angle to the entrance of said goal, said first sensing means sensing the presence of said magnetic playing element adjacent said goal opening.

10. The preprogrammed coin operated game apparatus defined in claim 9, characterized in that said game apparatus includes a second sensing means incluidng a normally open electrical switch adjacent said goal passage connected to said second input of said audio generating means, whereby said audio generating means generates a different sound upon receipt of said magnetic playing element in said goal passage.

11. A coin operated hockey game apparatus, comprising: a frame, a rectangular generally flat playing surface supported on said frame, a plurality of hockey figures supported above said playing surface and moveable relative to said playing surface, a hockey puck-like playing element on said playing surface moveable relative to said playing surface upon engagement by one of said playing figures, each of said playing figures including a hockey stick extending from said figure including an end portion extending generally parallel to said playing surface, goals at opposite ends of said playing surface each having an opening receiving said playing element, an electical control circuit means including sensing means and score indicating sensing the scoring of a goal and indicating the score, a clear plastic dome enclosing and hermetically sealing said playing surface having a top surface spaced from said hockey playing figures, a plurality of manual control means extending from said frame connected to said hockey playing figures and adapted to move said playing figures relative to said playing surface, said playing surface including inclined ramp surfaces adjacent to opposed corners of said playing surface maintaining said playing element on said playing surface for engagement by said figures, said hockey stick end portion of said hockey figures adjacent said ramp surfaces having a length sufficient to engage said ramp surfaces and said hockey figures adjacent to corners of said playing surface opposite said two opposed corners each having a hockey stick end portion longer than the end portions of said hockey figures adjacent said ramp surfaces permitting said figures to engage a playing element at said opposite playing surface corners.

* * * * *